US007976414B2

(12) United States Patent
McKay

(10) Patent No.: US 7,976,414 B2
(45) Date of Patent: Jul. 12, 2011

(54) METHOD OF A PLAYER USING BALL THROWING DEVICE

(75) Inventor: David Lawrence McKay, Scottsdale, AZ (US)

(73) Assignee: Throwing Partner, LLC, Chesterfield, MO (US)

( * ) Notice: Subject to any disclaimer, the term of this patent is extended or adjusted under 35 U.S.C. 154(b) by 0 days.

(21) Appl. No.: 13/022,832

(22) Filed: Feb. 8, 2011

(65) Prior Publication Data

US 2011/0130224 A1 Jun. 2, 2011

Related U.S. Application Data

(62) Division of application No. 12/394,743, filed on Feb. 27, 2009, now abandoned.

(60) Provisional application No. 61/035,098, filed on Mar. 10, 2008.

(51) Int. Cl.
*A63B 69/00* (2006.01)

(52) U.S. Cl. ..... 473/458; 473/424

(58) Field of Classification Search ..... 473/423–430, 473/451, 458; 47/42
See application file for complete search history.

(56) References Cited

U.S. PATENT DOCUMENTS

| | | | | | |
|---|---|---|---|---|---|
| 667,563 | A * | 2/1901 | Oakley | 473/424 |
| 795,960 | A * | 8/1905 | Cook | 473/424 |
| 3,767,198 | A * | 10/1973 | Boyer | 473/423 |
| 3,843,126 | A * | 10/1974 | Bandy | 473/576 |
| 3,934,873 | A * | 1/1976 | Griffin | 473/424 |
| 3,940,133 | A * | 2/1976 | Civita | 473/424 |
| 4,032,145 | A * | 6/1977 | Tami | 273/317.8 |
| 4,127,268 | A * | 11/1978 | Lindgren | 473/576 |
| 4,333,658 | A * | 6/1982 | Giovetti | 473/424 |
| 5,083,797 | A * | 1/1992 | Vartija et al. | 473/424 |
| 5,238,241 | A * | 8/1993 | Christensen | 473/424 |
| 5,452,888 | A * | 9/1995 | Glenn | 473/424 |
| 5,597,159 | A * | 1/1997 | Haygood et al. | 473/424 |
| 5,615,879 | A * | 4/1997 | Bailey | 473/424 |
| 5,772,542 | A * | 6/1998 | Gildea et al. | 473/576 |
| 5,853,339 | A * | 12/1998 | Scerbo | 473/576 |
| 5,916,046 | A * | 6/1999 | Allred et al. | 473/430 |
| 5,976,041 | A * | 11/1999 | Banker, Sr. | 473/576 |
| 6,227,988 | B1 * | 5/2001 | Bodman | 473/424 |
| 6,352,484 | B1 * | 3/2002 | Killion | 473/424 |
| 6,685,582 | B2 * | 2/2004 | Abel | 473/508 |
| 6,837,808 | B1 * | 1/2005 | Hatch | 473/424 |
| 6,884,187 | B2 * | 4/2005 | Cataldi et al. | 473/451 |
| 6,918,842 | B2 * | 7/2005 | Miller | 473/424 |
| 6,971,963 | B2 * | 12/2005 | Abel | 473/508 |
| 7,364,518 | B2 * | 4/2008 | Abel et al. | 473/508 |
| 2004/0009833 | A1 * | 1/2004 | Selevan | 473/576 |
| 2005/0014580 | A1 * | 1/2005 | Silman et al. | 473/424 |
| 2006/0183570 | A1 * | 8/2006 | Gamsaragan et al. | 473/424 |
| 2007/0142136 | A1 * | 6/2007 | Anthony Miles | 473/576 |
| 2007/0155544 | A1 * | 7/2007 | Killion | 473/424 |
| 2009/0075763 | A1 * | 3/2009 | Wu et al. | 473/424 |
| 2009/0298619 | A1 * | 12/2009 | Tice | 473/425 |

* cited by examiner

*Primary Examiner* — Mark S Graham
(74) *Attorney, Agent, or Firm* — Senniger Powers LLP

(57) ABSTRACT

A method of a player using a ball throwing device comprising a flexible but substantially non-stretchable flexible line attached at one end to the baseball or softball. The method comprises attaching the substantially non-stretchable flexible line to a non-throwing arm of a player, and using the throwing arm to throw the ball such that it travels along a path which arcs around a non-throwing side of the player to a location in front of the player where the ball may be caught.

17 Claims, 14 Drawing Sheets

METHOD OF A PLAYER USING BALL THROWING DEVICE

CROSS-REFERENCE TO RELATED APPLICATION

This application is a Divisional Patent Application and claims priority from U.S. Non-Provisional patent application Ser. No. 12/394,743, filed Feb. 27, 2009, which is a Non-Provisional Patent Application based on Provisional Patent Application Ser. 61/035,098, filed Mar. 10, 2008, hereby incorporated by reference.

FIELD OF THE INVENTION

The present invention generally relates to sporting goods and more particularly to a ball throwing device and method of using it.

BACKGROUND OF THE INVENTION

The ability to throw a ball is a basic skill in many sports, including baseball and softball, and practice is essential not only to improve a player's skill but also to keep a healthy arm in shape and to rehabilitate an arm that has been injured. Traditionally, throwing a ball repeatedly has required a partner to return the ball for another throw. Further, substantial space is required.

SUMMARY OF THE INVENTION

In general, this invention is directed to a method of using a ball throwing device comprising a flexible but substantially non-stretchable flexible line attached at one end to the baseball or softball. The player has a throwing arm, a non-throwing arm, and a body. The method comprises attaching the substantially non-stretchable flexible line to the non-throwing arm, and using the throwing arm to throw the ball such that it travels along a path which arcs around a non-throwing side of the player to a location in front of the player where the ball may be caught.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
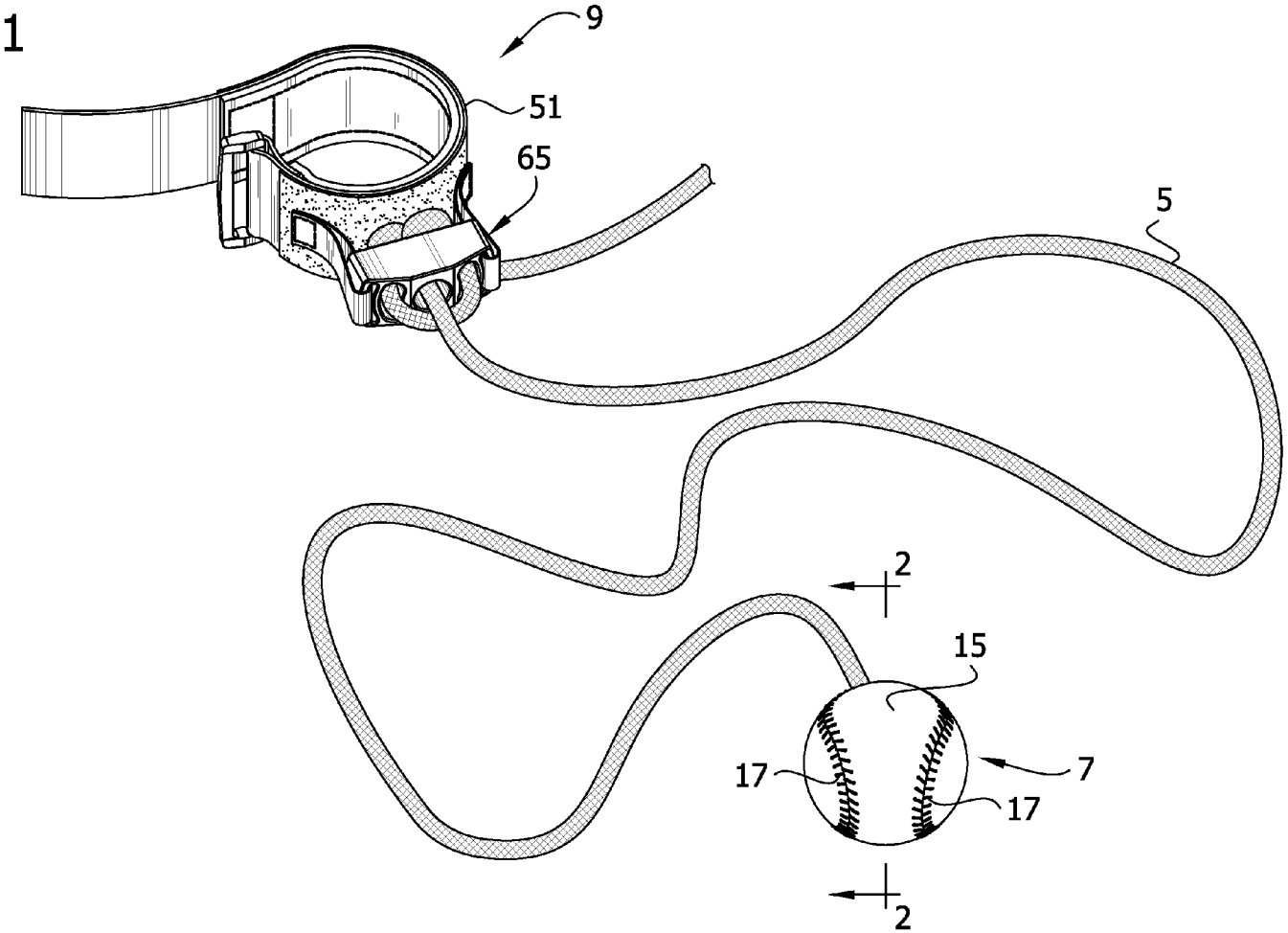
FIG. 1 is a perspective of a first embodiment of a ball throwing device of this invention.

Referring to the drawings, FIG. 1 shows one embodiment of a ball throwing device of this invention, generally designated 1. The device comprises a flexible line 5, a ball 7 attached to one end of the line, and a connection device 9 secured to the line at a position spaced from the ball. In this embodiment, the connection device 9 is adapted to be attached to a non-throwing arm of a thrower. The flexible line 5 limits the distance the ball 7 will travel when it is thrown by the thrower, thus eliminating the need for a throwing partner to return the ball. The components of the ball throwing device 1 and its operation are described in detail hereinafter.

The flexible line 5 is desirably of a relatively lightweight material and should be sufficiently strong to withstand the force exerted by the thrown ball without breaking. Desirably, the line is substantially non-stretchable so that it does not snap the ball 7 back toward the thrower after the ball is released and reaches the limit of the line. In one embodiment, the line 5 is braided nylon and polypropylene rope having a diameter in the range of ⅛ in. to ⅜ in., e.g., 5/16 in. and a work load of 192 pounds, but the line may be of other materials and have other diameters. For greater life, the line is desirably abrasion resistant. Desirably, the length of line 5 between the ball 7 and the connection device 9 is about equal to or slightly less the wingspan of the thrower. Accordingly, this length may vary from person to person according to the size and preference of the thrower. An exemplary range is five feet for younger and/or shorter throwers and seven feet for older and/or taller throwers.

The ball 7 is of suitable size and weight and, in some embodiments, may be an official baseball or softball (e.g., a 9-oz. major league baseball) having an outer leather cover 15 formed by pieces connected by raised stitched seams 17. Alternatively, the ball may simulate an "official" ball in size, weight and appearance. In other embodiments, the ball 7 may be somewhat lighter than an official ball to compensate for the weight of some portion of the line 5 attached to the ball.

Figure 2:
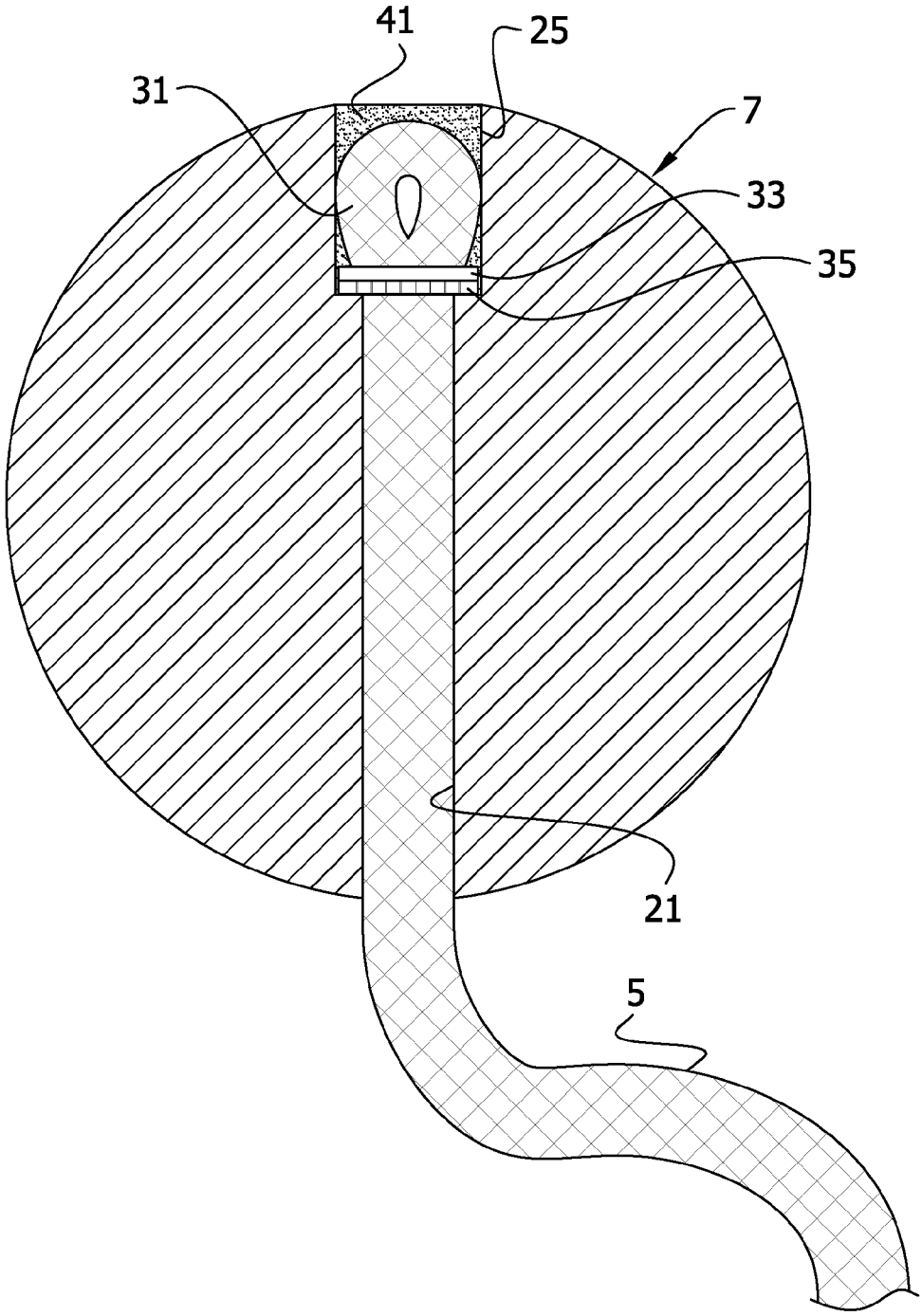
FIG. 2 is a sectional view showing a connection between a ball and flexible line of the ball throwing device of FIG. 1.

Desirably, the ball 7 is attached to the flexible line 5 so that it protrudes from the ball at a location toward the outside of the ball away from the gripping location of the ball so that the line does not interfere with the throwing of the ball. FIG. 2 illustrates one way of attaching the ball 7 to the flexible line 5. In this embodiment, the ball 7 has a central bore 21 extending through the ball from one side of the ball to the other, and one end of this bore is enlarged by a counterbore 25. The central bore 21 has a diameter only slightly greater than the diameter of the line 5. The counterbore has a diameter about twice the diameter of the line. The line 5 extends through the bore 21 and has a free end portion which is doubled back on itself to form a double-back portion 31. The double-back portion 31 is held in this configuration by a pair of lock washers 33, 35, one of which (33) is a split-ring lock washer and the other of which (35) is a lock washer with external teeth. The entire assembly (double-back portion 31 and lock washers 33, 35) is secured in the counterbore 25 by glue 41 or other suitable material fill material in the counterbore. Excess material is removed so that the outer surface of the ball 7 is smooth and uniform over the counterbore 25. The ball may be attached to the line 5 in other ways. By way of example but not limitation, the line 5 may be integrally formed with the core of a ball.

Figure 3:
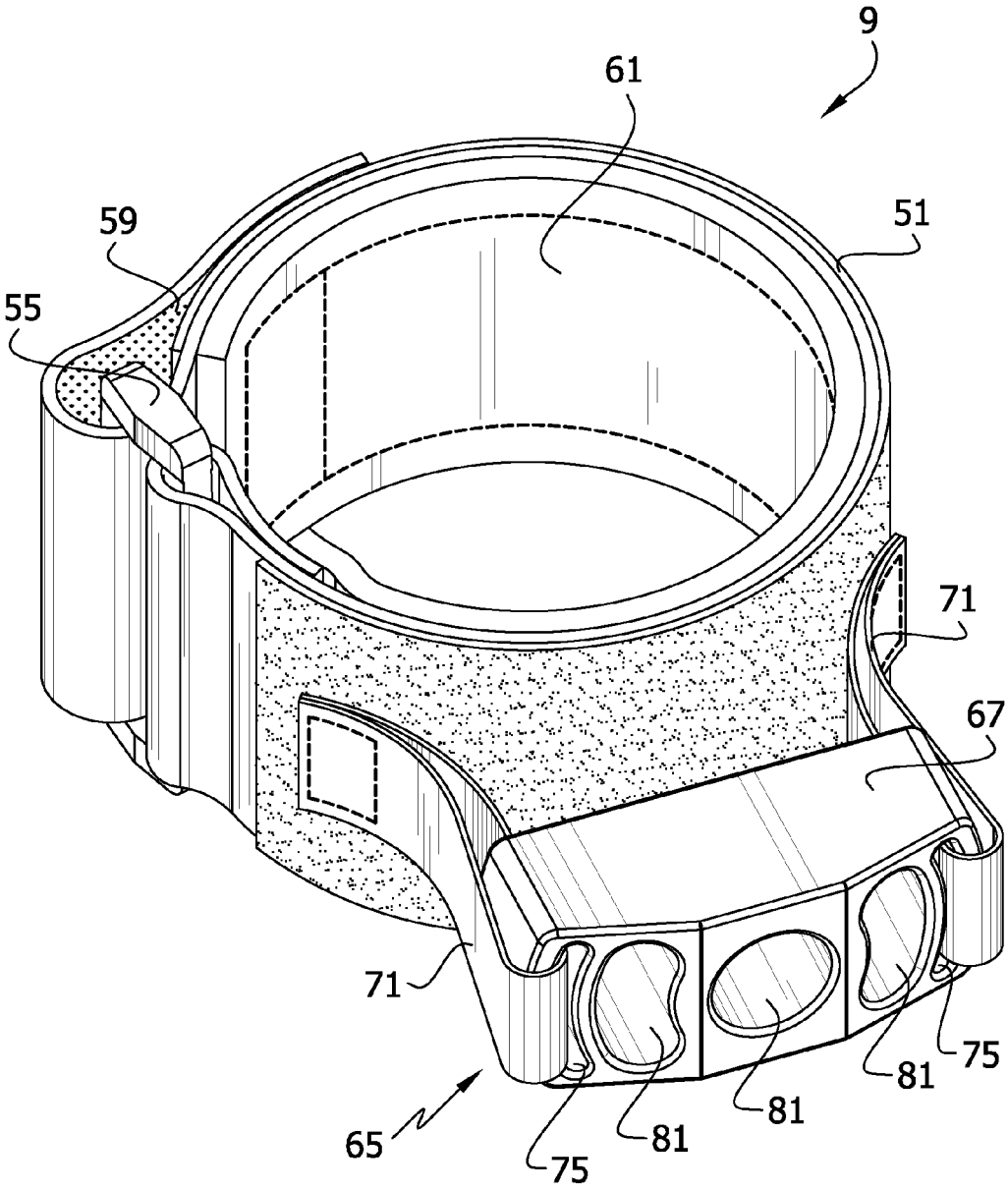
FIG. 3 is a perspective of a line connector for connecting the flexible line to an arm strap of the device.
Figure 4A:
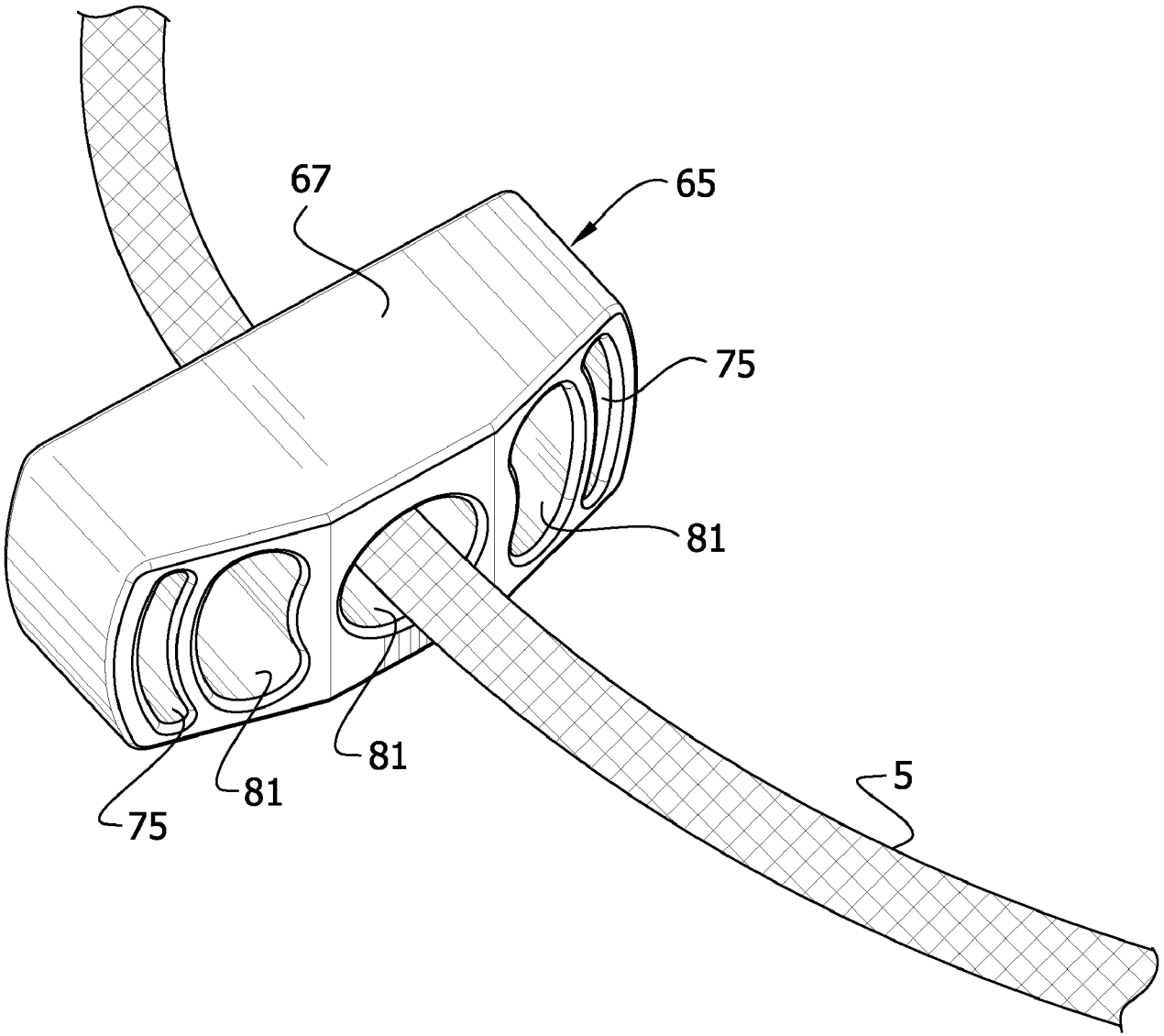
FIGS. 4A-4D illustrate one exemplary way of securing a flexible line to the line connector
Figure 4B:
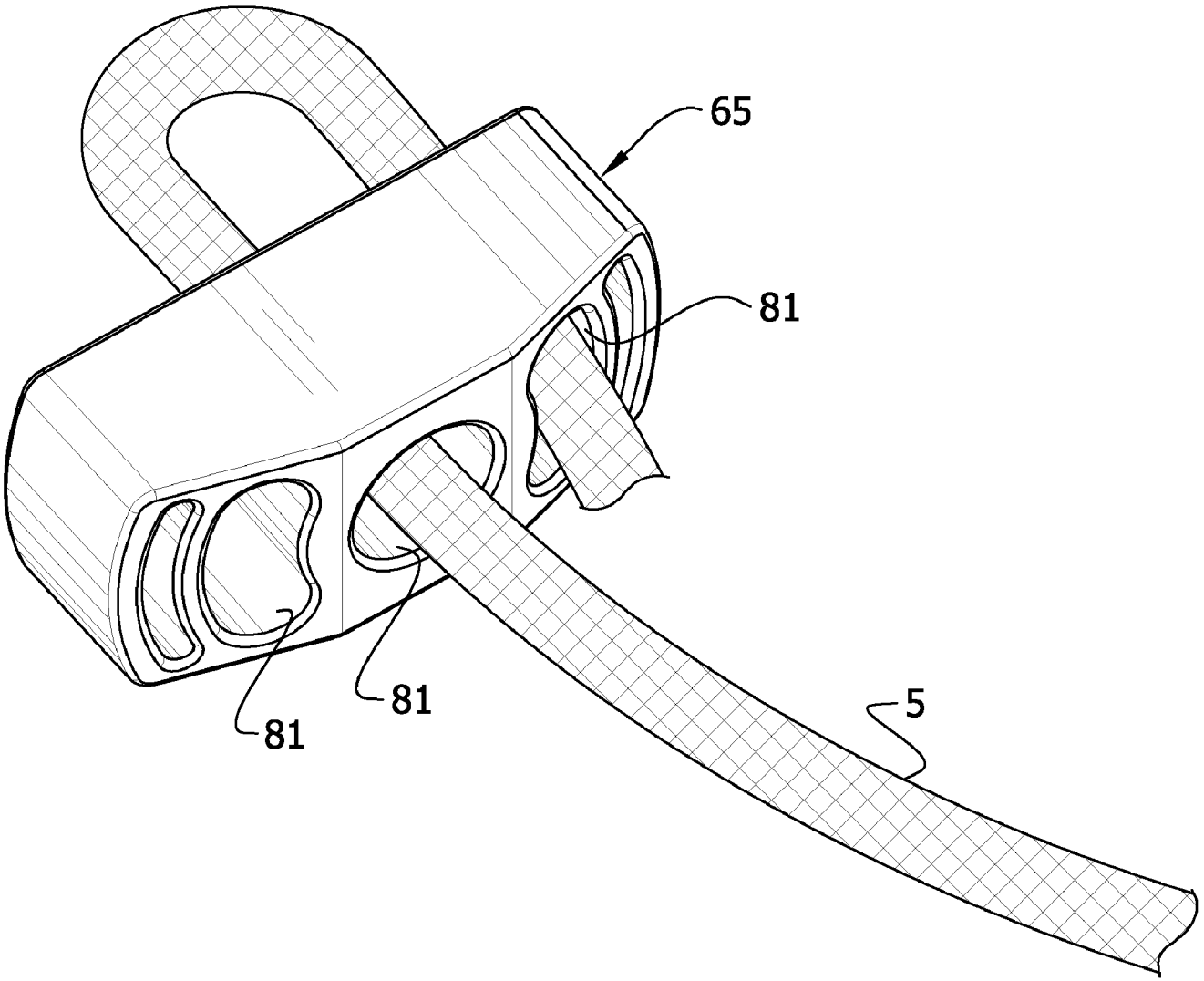
Figure 4C:
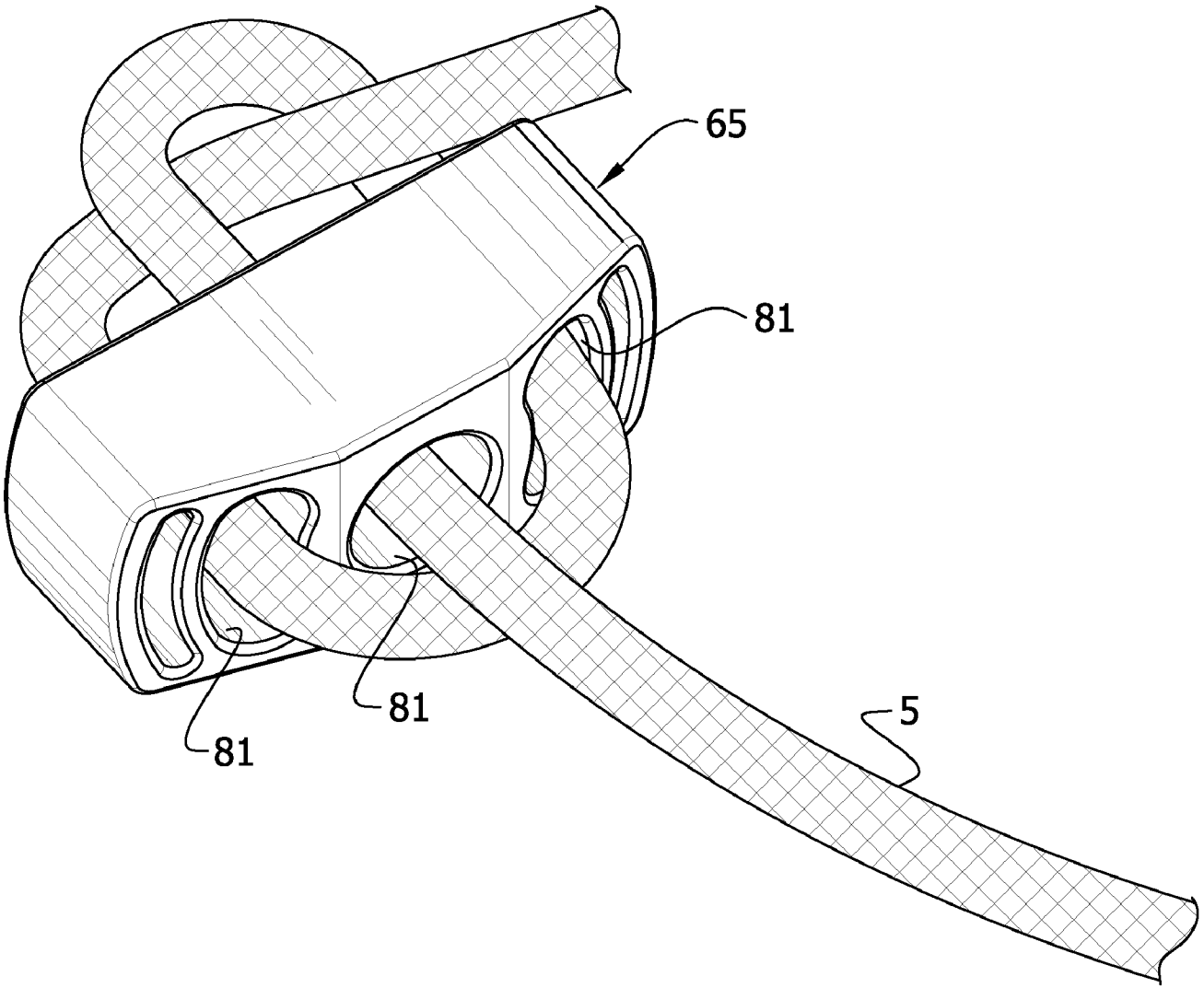
Figure 4D:
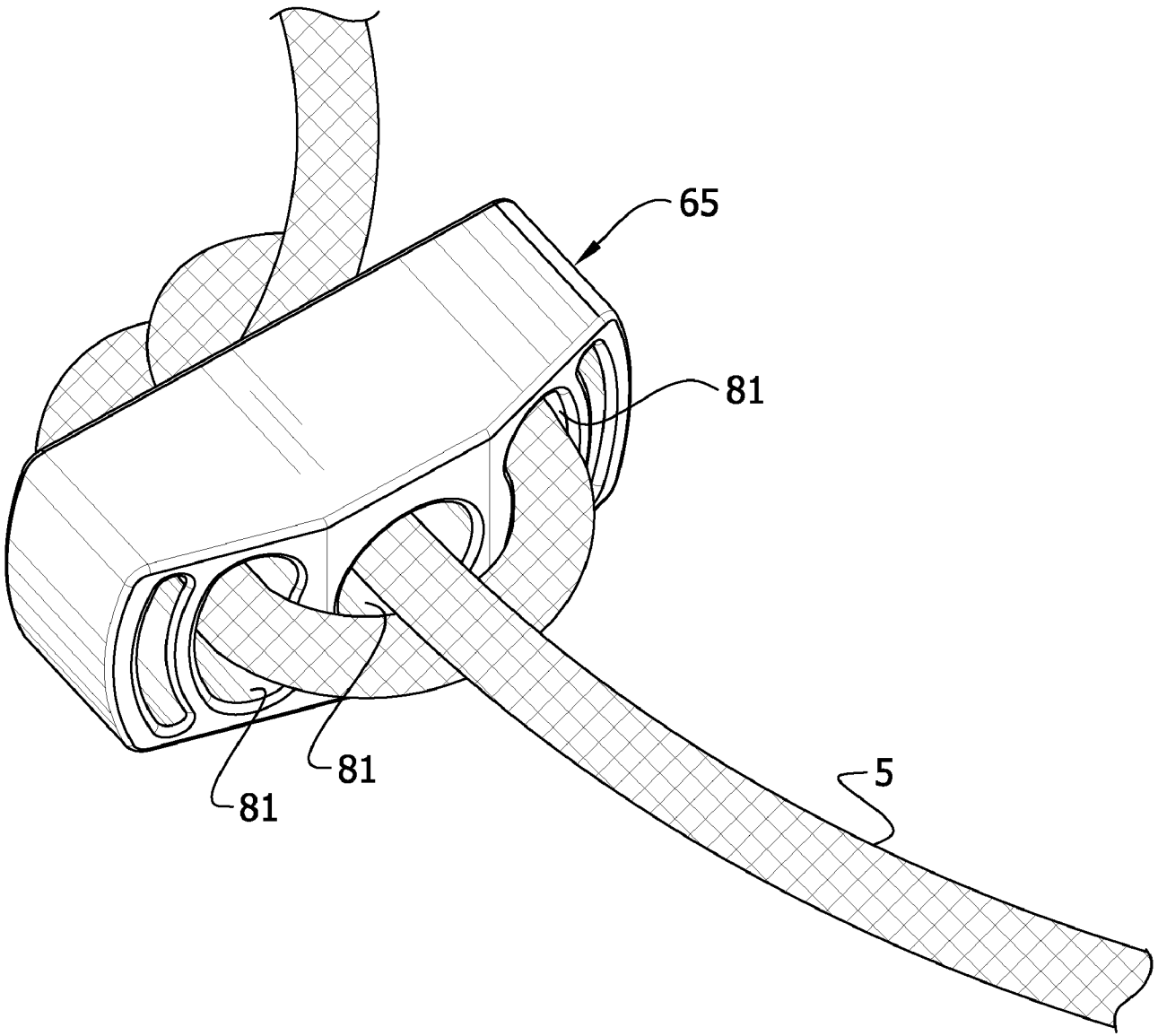

Referring to FIG. 3, the connection device 9 comprises a strap 51, a rigid adjustment loop 55, and a hook-and-loop (e.g., Velcro®) fastener 59 for adjustably attaching the device to the non-throwing arm (e.g., wrist) of a thrower. The strap 51 is of suitable length and width (e.g., sixteen inches long and two inches wide) and has padding 61 on its inner surface for comfort. The device 9 also includes a line connector, generally designated 65, for connecting the line 5 to the strap 51. The connector 65 comprises a connecting member 67 secured to the strap 51 by flexible loops 71 extending through holes 75 in the member. The connecting member 67 is of a substantially rigid material, e.g., hard plastic, having one or more openings 81 (three or shown in FIG. 3) for receiving the flexible line 5. The line 5 is movable through the one or more openings 81 to adjust the length of line between the device 9 and the ball. By way of example, this length may correspond to a distance just short of the wingspan of the person throwing the ball. The line is secured to the device 9 by feeding the line through the opening(s) 81 until there is an appropriate length of line between the device 9 and the ball 7, and then either tying the line to itself or knotting the line to secure it in place. FIGS. 4A-4D illustrate one exemplary way to secure the line 5 to the connecting member 67. Desirably, the line is tied off in a way which prevents slippage of the line yet permits ready adjustment of the line to provide more or less length between the device and the ball.

The connection device 9 described above can be used while a glove is worn on the hand of the non-throwing arm. Further, the device is easy to apply to the arm and permits ready adjustment of the length of line 5 between the ball 7 and the connecting device as appropriate to meet the needs or desires of the thrower.

Figure 5:
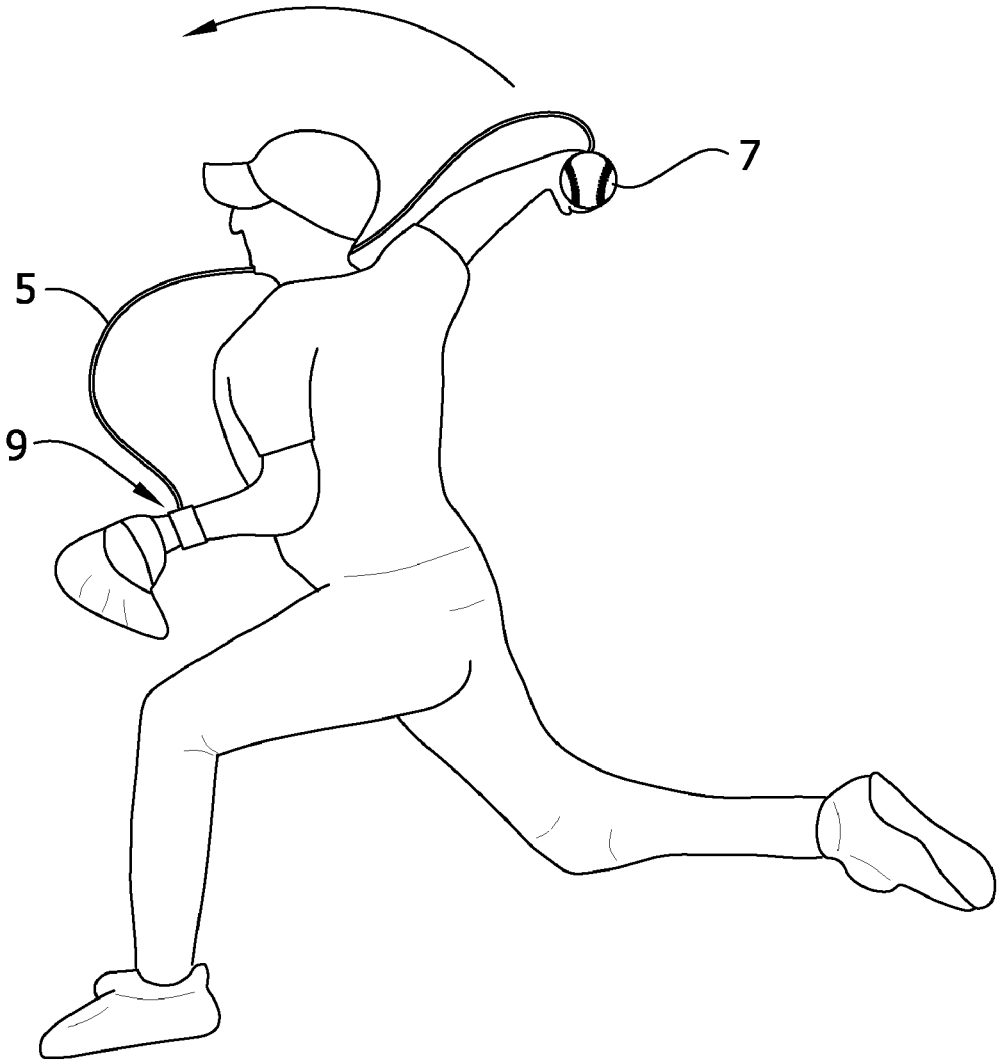
FIGS. 5 and 6 are schematic views illustrating one way of how the throwing device may be used by a thrower.
Figure 6:
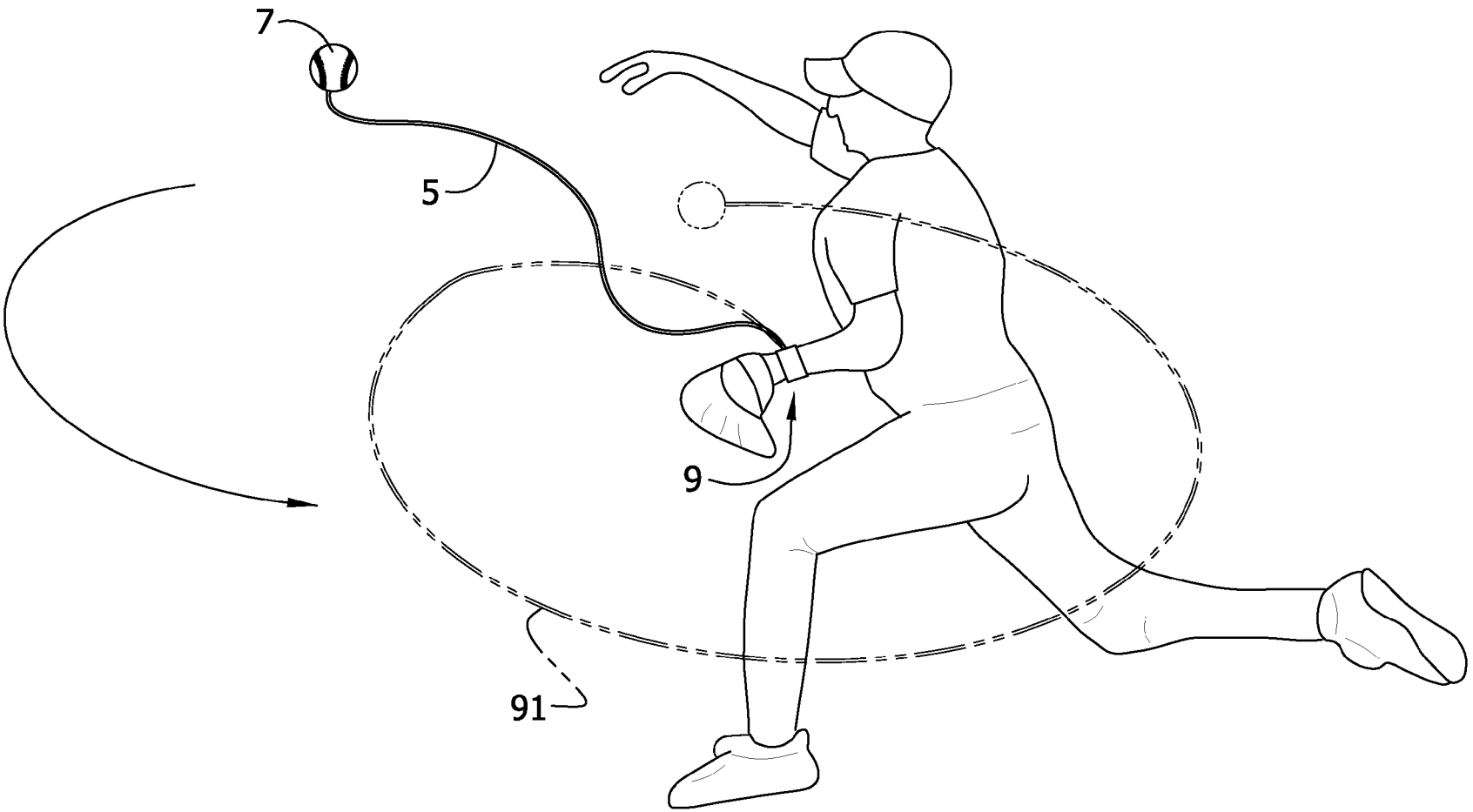

FIGS. 5 and 6 illustrate how the throwing device 1 is used by a thrower. The length of flexible line 5 between the connection device 9 and the ball is first adjusted to suit the thrower, as described above. The strap 51 of the connection device 9 is then attached to the non-throwing arm, e.g., at the wrist, with the connecting member 67 positioned on the underside of the wrist. The ball can be gripped in any manner desired the thrower. Using a natural throwing motion, the ball is then thrown in a generally forward direction. The precise angle of throw is not important because the throwing device will perform properly regardless of the direction in which the ball is thrown. Once released, the travel of the ball 7 is limited by the length of the line (e.g., five to seven feet). After reaching this limit, the ball will return to the player, generally along a trajectory or path which, for a right-hand thrower, will arc around the left (non-throwing) side of the body to a location in front of the player where the ball may be captured and another throw made. An exemplary path 91 followed by the ball after release is shown in phantom lines in FIG. 6.

Figure 7:
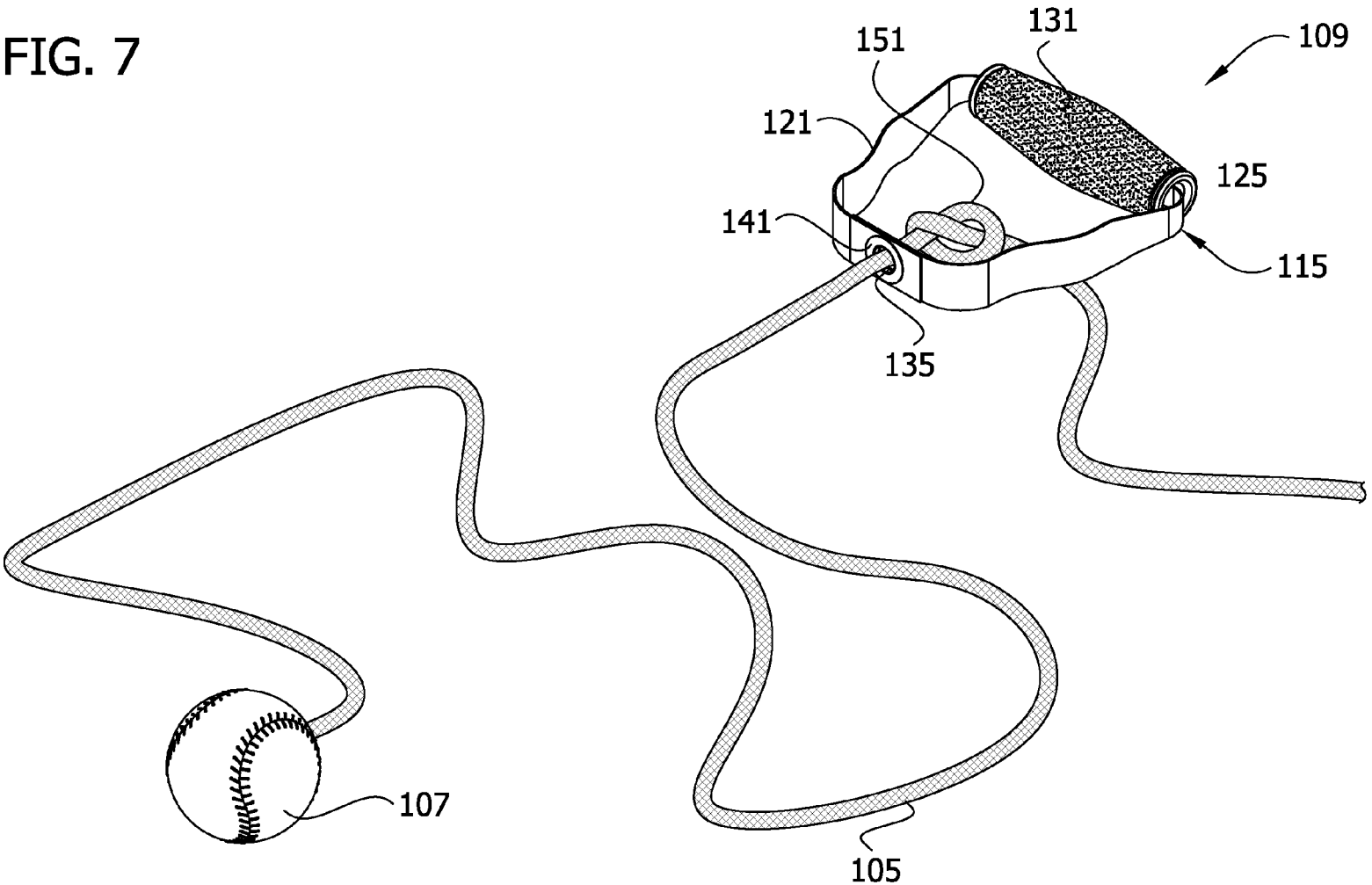
FIG. 7 is a perspective illustrating a second embodiment of the throwing device.

FIG. 7 shows a second embodiment of the throwing device, generally designated 101. This device also includes a flexible line 105, a ball 107 attached to the line, and a connection device 109 secured to the line at a location spaced from the ball. The flexible line 105 and ball 107 are identical to the line 5 and ball 7 of the first embodiment; the connection device 109 is different. In this embodiment, the connection device 109 comprises a handle, generally indicated at 115 in FIG. 7, which is adapted to be grasped and held by the non-throwing arm (hand) of the thrower, thus establishing a connection between the ball and the thrower. The handle comprises a flexible strap 121 formed as a loop, a tubular sleeve 125 on the strap, and a grip 131 on the sleeve of cushioning material sized to be grasped by the non-throwing hand. The strap 121 has an opening 135 in it reinforced by a grommet 141 for receiving the line 105, the line being movable through the grommet to adjust the length of line between the ball and the handle 115. The line is knotted at the appropriate location (e.g., indicated at 151 in FIG. 7) so that it cannot pass back through the grommet 141, thus establishing the length of line between the device 109 and ball 107. Further reinforcement against pull-back of the line through the opening in the strap can be provided by a washer (not shown in FIG. 7). The handle 115 may have other configurations without departing from the scope of this invention.

The ball throwing device 101 is used in the same manner as the device 1 of the first embodiment, except that the handle 115 is grasped by the non-throwing hand of the thrower.

Figure 8:
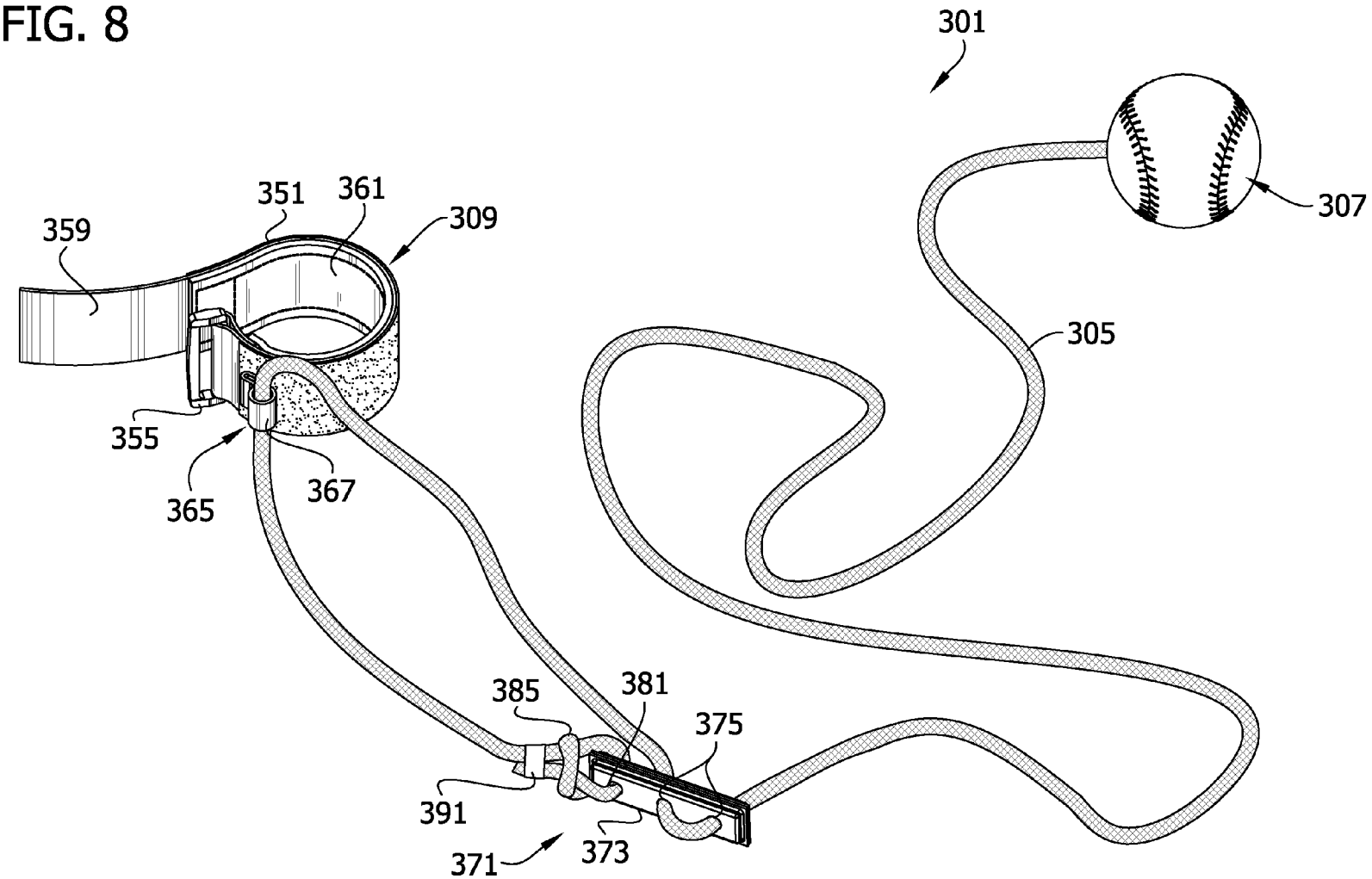
FIG. 8 is a perspective illustrating a third embodiment of the throwing device.

FIGS. 8-11 illustrate a third embodiment of the throwing device, generally designated 301. As shown in FIG. 8, this device also includes a flexible line 305, a ball 307 attached to the line, and a connection device 309 secured to the line at a location spaced from the ball. The flexible line 305 and ball 307 are identical to the line 5 and ball 7 of the first embodiment. The connection device 309 is different. In this embodiment, the connection device 309 comprises a strap 351, a rigid adjustment loop 355, and a hook-and-loop (e.g., Velcro®) fastener 359 for adjustably attaching the device to the non-throwing arm (e.g., wrist) of a thrower. The strap 351 is of suitable length and width (e.g., 12-15 inches long and two inches wide) and has padding 361 on its inner surface for comfort. The device 301 also includes a line connector, generally designated 365, for connecting the line 305 to the strap 351. The connector 365 comprises a connecting member 367 which, in this embodiment, is a loop of material attached (e.g., by stitching) to the strap 351.

Figure 9:
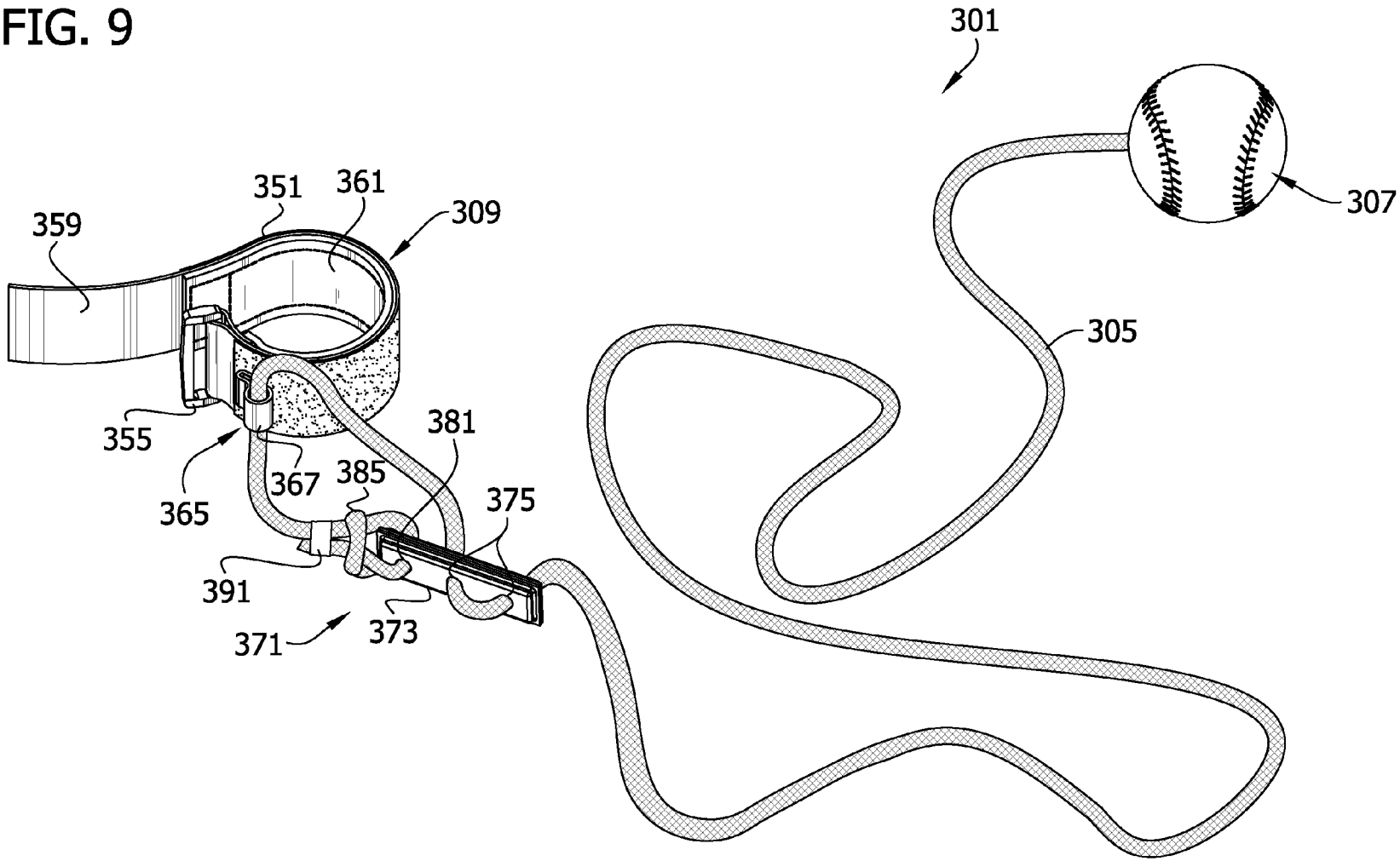
FIG. 9 is a view similar to FIG. 8 showing the flexible line adjusted to a longer throwing length than the line of FIG. 8.
Figure 10:
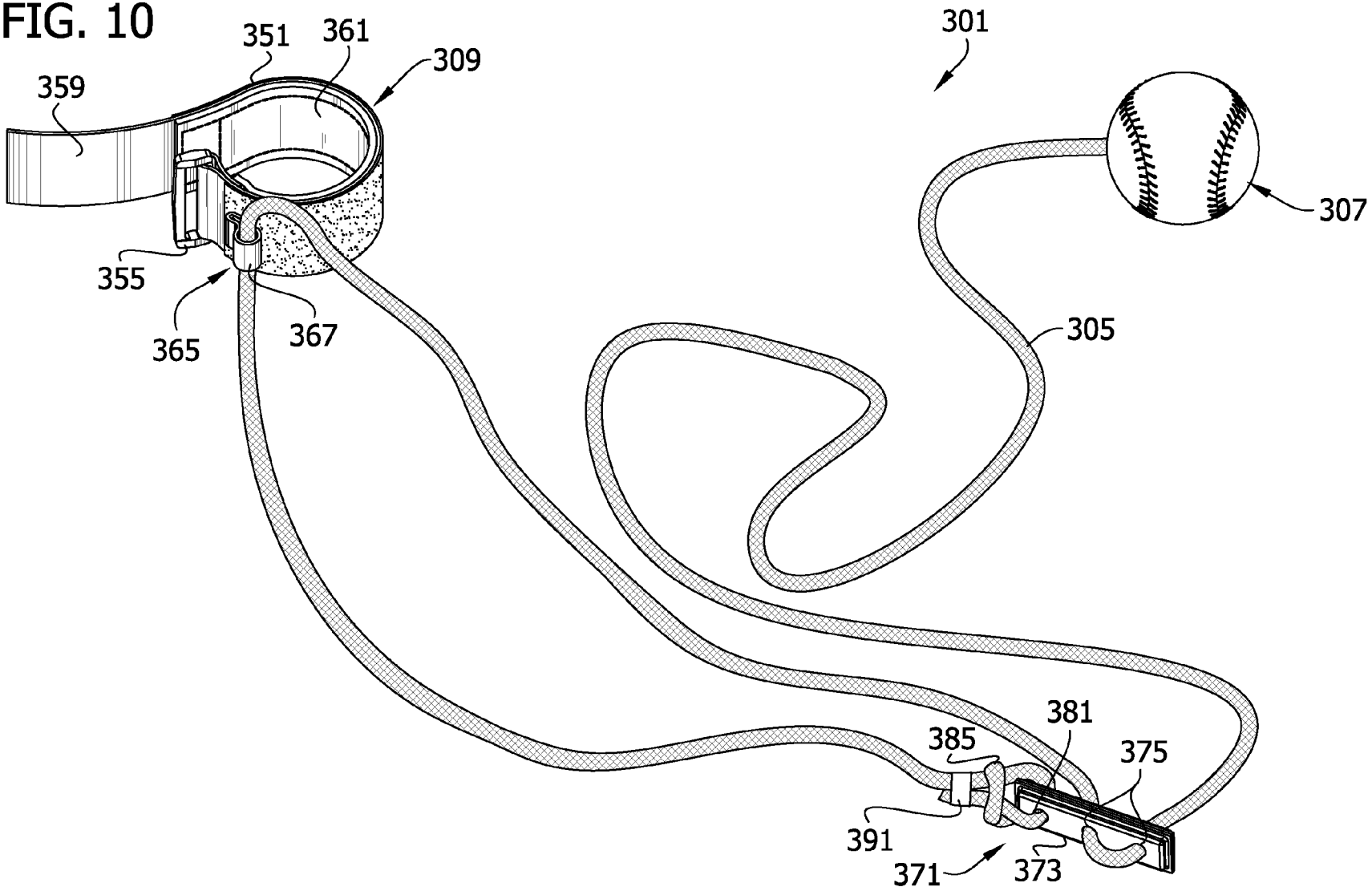
FIG. 10 is a view similar to FIGS. 8 and 9 showing the flexible line adjusted to a shorter throwing length.

The throwing device 301 includes an adjustment device, generally designated 371, for adjusting the throwing length of the flexible line 305, that is, the length of line between the ball 307 and the connection device 309. The adjustment device 371 comprises an elongate substantially rigid adjustment member 373 having a first and second adjustment openings 375 in it spaced lengthwise of the adjustment member for receiving a portion of the flexible line 305 between the ball 307 and the line connector 365, and a third opening 381 for securing the free end of the line (i.e., the end opposite the ball) to the adjustment member 373, as by a knot 385 and adhesive tape 391. To lengthen the throwing length of the line 305, the line is threaded through the adjustment openings 375 to move the adjustment member 373 toward the line connector 365 (FIG. 9). To shorten the throwing length of the line 305, the line is threaded through the adjustment openings 375 to move the adjustment member 373 away from the line connector 365 (FIG. 10).

Figure 11:
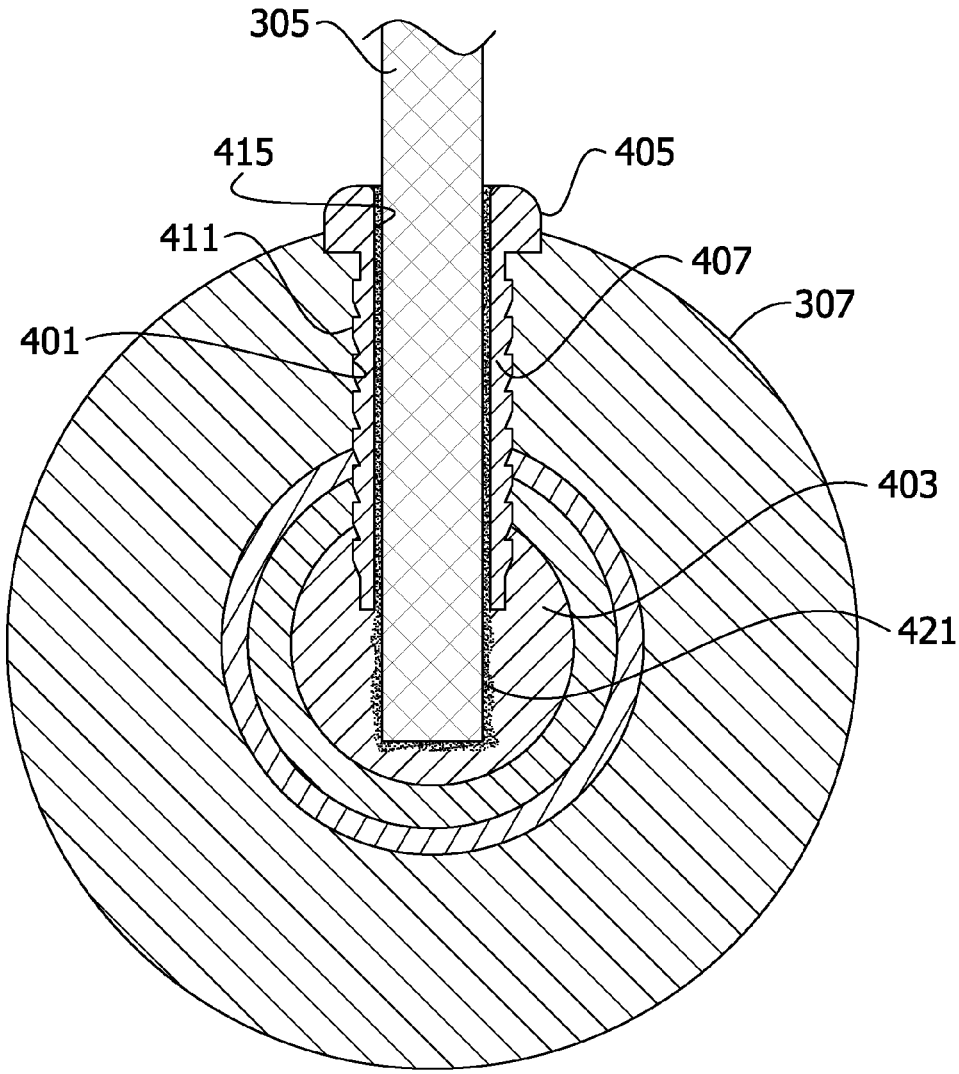
FIG. 11 is a sectional view showing a connection between a ball and flexible line of the ball throwing device of FIG. 8.

FIG. 11 illustrates one way of connecting the ball 307 to the flexible line 305. In this embodiment, the ball is formed with a radial bore 401 extending from the outer surface of the ball generally to the core 403 (e.g., "pill") of the ball. An anchor 405 having a tubular body 407 is secured in the bore by external threads or barbs 411 on the body. Adhesive may also be used to secure the anchor in place. The line 305 extends through a longitudinal opening 415 in the body 407 of the anchor and into the core 403 of the ball. The line is secured in place by adhesive 421. The line 305 may be secured to the ball 307 in other ways without departing from the scope of this invention.

The ball throwing device 301 is used in the same manner as the device 1 of the first embodiment.

The ball throwing devices 1, 101, 301 can be used in many ways, some of which are described below.

For example, the throwing devices 1, 101 can be used by a pitcher while using any grip on the ball 7, 107, 307, e.g., a two-seam fastball, a four-seam fastball, a slider, curve ball, split-finger, fork ball, change-up, knuckle ball, etc. The pitcher can throw out of the wind-up or stretch position and can work on pick-off throws to any base. The pitcher can also throw into a mirror and watch without the need to use video.

A catcher can work on coming out of the crouch and throwing to any base. The catcher can also place the ball in his or her glove, simulate dropping down to block a ball, and then getting up and throwing to a base. The catcher can also place the ball in his or her glove and then simulate fielding a bunt down either base line and throwing to any base.

A first-base player can place the ball in his or her glove, simulate bending over and fielding a ground ball, and then throwing to 2nd base for a force out or double play. The player can simulate fielding a ball and pivoting either to right or left before making the throw. The player can also simulate fielding a ground ball and feeding the pitcher covering first base.

A second-base player can place the ball in his or her glove and then simulate fielding a ground ball and making any type of throw to first or second base. The player can also work on turning the double play and throwing to first base, either staying at second base or coming across the bag.

A shortstop player can place the ball in his or her glove, simulate fielding a ground ball hit straight at the player or to the player's forehand or backhand, and then coming up and throwing to first or second base. The player can also work on charging a ground ball hit slow and making the throw to either base. Further, the player can work on turning a double play. A third-base player can place the ball in his or her glove and simulate fielding any type of ground ball and throwing to first base, second base or home plate. The player can also work on charging the bunt and throwing to first base, second base or home plate.

An outfield player can place the ball in his or her glove and simulate fielding a ground ball or fly ball and making a throw back to the infield. In general, the throwing devices 1, 101 enable coaches and players to keep their arms in shape by throwing year round and concentrating on their motion. Further, since the throwing device 1, 101, 301 requires very little room to use, players or non-players can throw in confined areas, e.g., in the garage or basement during the off-season (e.g., winter months). It is a fact that players have fewer arm problems if they throw all year round.

The throwing devices 1, 101 are also useful tools for rehabilitation facilities. The devices will allow rehabbing players to throw a ball while allowing a therapist to concentrate on watching the players' motion rather than looking to catch the thrown baseball. Moreover, instead of backing up and then shortening up a throw because the player feels a slight pain, the player can simply throw at his own pace.

The throwing devices 1, 101, 301 can be used during games, e.g., by enabling players to throw on the side, without a partner, to get ready to go into the game. The devices are believed to be useful for teams at any level of skill and experience. The best way for a player to keep his or her arm in shape is to build arm strength by throwing a baseball. The throwing devices 1, 101 allow a player to pick a target and throw at the target as if the ball is not attached to the line.

The throwing devices 1, 101, 301 have several advantages over prior devices. In this regard, visualization is used often in all sports. Some say that a player can accomplish almost as much or more visualizing doing something than actually doing it. During spring training pitchers frequently visualize throwing off a mound by clenching a towel in their throwing hand. Pulling the towel through a throwing motion provides some resistance in an effort to simulate the feel of a baseball in hand. Pitchers will perform the same drill indoor in front of a mirror so they can view their mechanics. A coach can tell a pitcher his elbow is dropping or that his over the top arm motion is more like three quarters, but it will do little good until the player can actually see his mechanics on video or in a mirror. The throwing devices 1, 101, 301 will make that towel obsolete. Rather than throw with a clenched fist, the player will be throwing as he or she would in a game.

Traditional throwing baseball drills require a substantial amount of space and either a large supply of baseballs which must be retrieved by the thrower or someone to catch and return a thrown ball. The throwing devices 1, 101 described above eliminate these requirements. These devices require very little space, no supply of baseballs and no partner.

Having described the invention in detail, it will be apparent that modifications and variations are possible without departing from the scope of the invention defined in the appended claims. By way of example, the ball 7, 107, 307 may be attached to the line 5, 105, 305 in any way which allows the ball to be properly gripped by a person throwing it, and the device 9, 109, 309 for connecting the line 5, 105, 305 to the person throwing the ball may have any construction suitable for being grasped by or attached to the person. In this regard, the throwing devices 1, 101, 301 described above are configured to be either attached to or grasped by the non-throwing arm of a person throwing the ball. However, it is contemplated that a ball throwing device of this invention may include a connection device which is adapted for connection to a non-throwing part of or on the thrower other than the non-throwing arm. For example, the connection device could be configured for attachment to a leg or waist of the person or to a belt or other apparel on the person.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A method of a player using a ball throwing device comprising a flexible but substantially non-stretchable line attached at one end to a baseball or softball, the player having a throwing arm, a non-throwing arm, and a body, the method comprising:

attaching the substantially non-stretchable flexible line to the non-throwing arm; and using the throwing arm to throw the ball such that it travels along a path which arcs around a non-throwing side of the player to a location in front of the player where the ball may be caught.

2. The method of claim 1, further comprising the player catching the ball by the non-throwing arm after the ball is thrown and travels along said path.

3. The method of claim 2, further comprising the player simulating catching the ball before throwing the ball.

4. The method of claim 3, further comprising the player simulating fielding a ground ball or fly ball and then throwing the ball back to the infield.

5. The method of claim 3, further comprising the player simulating dropping down to block a ball and then getting up and throwing the ball to a base.

6. The method of claim 3, further comprising the player simulating fielding a bunt down a base line and then throwing to a base.

7. The method of claim 3, further comprising the player simulating bending over and fielding a ground ball and then throwing to second base for a force out or double play.

8. The method of claim 3, further comprising the player simulating fielding a ball and pivoting either to right or left and then throwing the ball.

9. The method of claim 3, further comprising the player simulating fielding a ground ball and then throwing the ball to a pitcher covering first base.

10. The method of claim 3, further comprising the player simulating charging a ground ball hit slow and then throwing the ball to either base.

11. The method of claim 3, further comprising the player simulating a pitcher's wind-up and then throwing the ball.

12. The method of claim 11, further comprising wherein said throwing the ball simulates making a throw toward home plate.

13. The method of claim 11, further comprising wherein said throwing the ball simulates making a pick-off move to a base.

14. The method of claim 1, wherein the non-stretchable flexible line is attached to a connecting device, and wherein said method further comprises using the connecting device to attach the non-stretchable flexible line to the non-throwing arm at the wrist.

15. The method of claim 2, further comprising adjusting the length of the line before throwing it and catching it.

16. The method of claim 2, wherein the ball is an official baseball of official size and weight.

17. The method of claim 2, wherein the ball is an official softball of official size and weight.

* * * * *